US009004486B1

(12) United States Patent
Foley et al.

(10) Patent No.: US 9,004,486 B1
(45) Date of Patent: Apr. 14, 2015

(54) ALIGNING SHEETS IN A SHEET RESTACKING TRAY USING ROTATING HELICAL BRUSHES

(71) Applicant: Xerox Corporation, Norwalk, CT (US)

(72) Inventors: Timothy P. Foley, Marion, NY (US); Frank B. Tamarez Gomez, Rochester, NY (US); Steven M. Russel, Bloomfield, NY (US); Jeffrey N. Swing, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/154,208

(22) Filed: Jan. 14, 2014

(51) Int. Cl.
*B65H 31/36* (2006.01)
*B65H 31/34* (2006.01)

(52) U.S. Cl.
CPC ..... *B65H 31/36* (2013.01); *B65H 31/34* (2013.01)

(58) Field of Classification Search
CPC ..... B65H 31/34; B65H 31/38; B65H 31/36; B65H 2301/42172
USPC ..... 271/207, 224, 220, 221
See application file for complete search history.

(56) References Cited

U.S. PATENT DOCUMENTS

| | | | | |
|---|---|---|---|---|
| 4,178,119 | A * | 12/1979 | Busch | 414/788 |
| 4,318,541 | A | 3/1982 | Nagel et al. | |
| 4,431,177 | A | 2/1984 | Beery et al. | |
| 4,556,211 | A | 12/1985 | Carr | |
| 4,828,246 | A | 5/1989 | Wegel et al. | |
| 4,836,527 | A | 6/1989 | Wong | |
| 4,844,440 | A | 7/1989 | Gray | |
| 4,953,845 | A * | 9/1990 | Castiglioni | 271/217 |
| 5,049,948 | A | 9/1991 | Brown et al. | |
| 5,188,353 | A | 2/1993 | Parks | |
| 5,678,159 | A | 10/1997 | Williams et al. | |
| 6,032,004 | A | 2/2000 | Mirabella, Jr. et al. | |
| 6,059,284 | A | 5/2000 | Wolf et al. | |
| 6,264,196 | B1 | 7/2001 | Lotsch | |
| 6,286,829 | B1 | 9/2001 | Emmrich | |
| 6,443,450 | B1 | 9/2002 | Antinora | |
| 7,562,869 | B2 | 7/2009 | Mao et al. | |
| 2004/0061282 | A1 * | 4/2004 | Stemmle | 271/207 |
| 2013/0241140 | A1 * | 9/2013 | Suleiman | 271/153 |

FOREIGN PATENT DOCUMENTS

| | | | | |
|---|---|---|---|---|
| EP | 0 378 005 B1 | | 6/1993 | |
| JP | 58109359 A | * | 6/1983 | B65H 31/34 |

* cited by examiner

*Primary Examiner* — Prasad Gokhale
(74) *Attorney, Agent, or Firm* — Gibb & Riley, LLC

(57) ABSTRACT

Devices and methods to collect and align print media sheets. According to a device herein, a tray has a base and receives print media sheets. Registration guides are connected to the tray. The registration guides define a corner in the tray. A tamper mechanism comprises a rotating helical brush extending perpendicularly from the base adjacent to a side of the tray opposite the corner. The tamper mechanism is positioned to tamp the print media sheets against the registration guides causing a stack of the print media sheets to be squared against the corner.

20 Claims, 7 Drawing Sheets

ALIGNING SHEETS IN A SHEET RESTACKING TRAY USING ROTATING HELICAL BRUSHES

BACKGROUND

Devices and methods herein generally relate to machines such as printers and/or copier devices and, more particularly, to methods to align sheets in a sheet restacking tray using rotating helical brushes.

In high speed printing devices there is a problem restacking sheets after they have been marked. The current scuffer roll belt and side tappers may not align sheets properly in a finished stack. The sheets may be offset or the stack may not be square, top to bottom.

SUMMARY

Disclosed herein is a sheet registration and restacking device consisting of helically wound rotating brushes. There is a prepositioned set of sheet guides forming a corner to align two sides of a sheet stack. The brushes may have either right hand pitch or left hand pitch relative to the orientation of the sheet stack. When a sheet enters the device the rotation of the brushes helical pitch moves the sheet downward and toward the stack edge guides. As the sheet settles into the stack, the brush gently nudges the sheet into the registration corner. The constant force of the brush maintains the position of the stack against the registration guide.

According to a device herein, a tray comprises a base. The tray receives print media sheets. Registration guides are connected to the tray. The registration guides define a corner in the tray. A tamper mechanism comprises a rotating helical brush extending perpendicularly from the base adjacent to a side of the tray opposite the corner. The tamper mechanism is positioned to tamp the print media sheets against the registration guides causing a stack of the print media sheets to be squared against the corner.

According to a sheet registering apparatus, the sheet registering apparatus includes a sheet-receiving tray and registration guides connected to the sheet-receiving tray. A first rotating brush is located at the left side of the sheet-receiving tray. The first rotating brush has a vertical shaft relative to a base of the sheet-receiving tray and bristles attached to the vertical shaft in a right-hand pitch helical pattern. A second rotating brush is located at the right side of the sheet-receiving tray. The second rotating brush has a vertical shaft relative to the base of the sheet-receiving tray and bristles attached to the vertical shaft in a left-hand pitch helical pattern.

According to a method of collecting and aligning print media sheets, a print media sheet is received into a sheet-receiving tray. The print media sheet is engaged with a tamper mechanism. The tamper mechanism comprises a rotating helical brush extending perpendicularly from a base of the sheet-receiving tray adjacent to a side of the sheet-receiving tray. The print media sheet is moved into the sheet-receiving tray toward registration guides, which define a corner in the sheet-receiving tray. The print media sheet is continuously tamped against the registration guides in order to compile a stack of print media sheets causing the stack to be squared against the corner.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
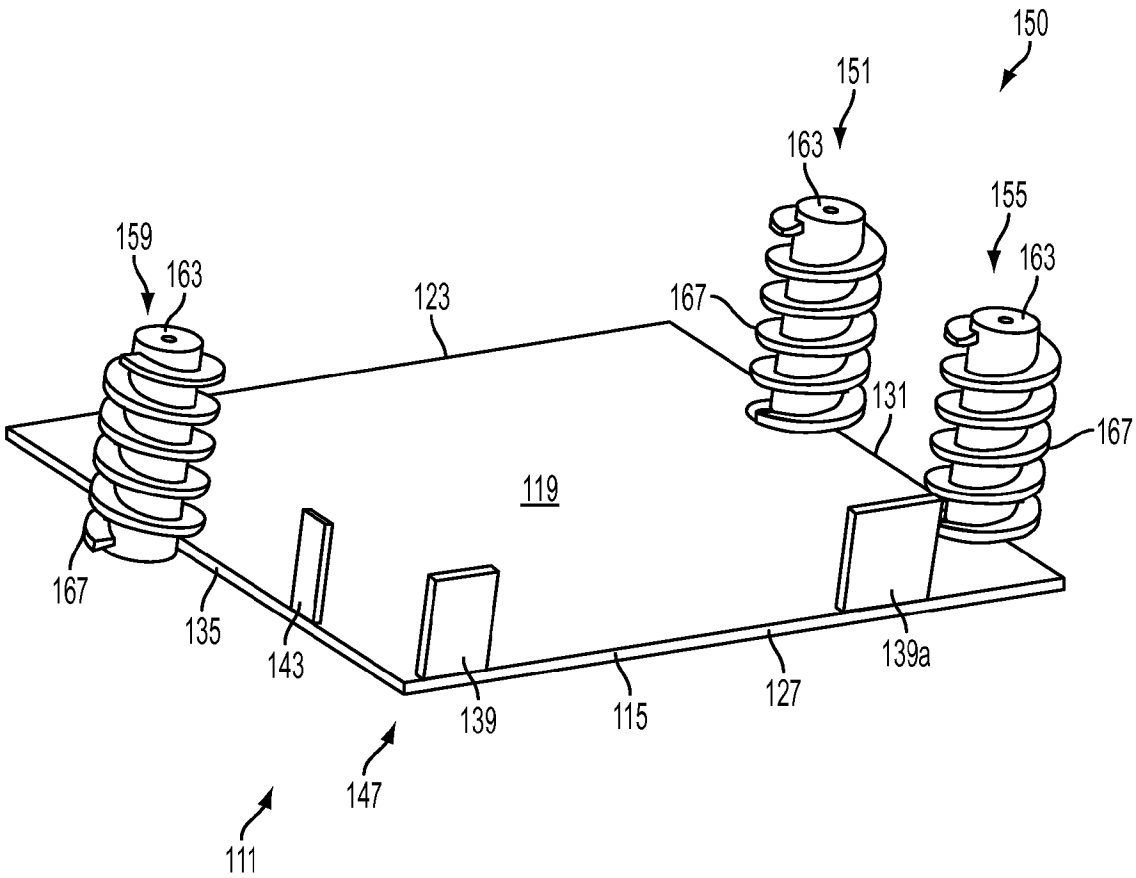
FIG. 1 is a perspective view of a sheet registering apparatus according to devices and methods herein.

The disclosure will now be described by reference to a printing apparatus that includes a device for collecting and aligning a stack of sheets of a printing device in a media sheet tray of the printer. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims. For a general understanding of the features of the disclosure, reference is made to the drawings. In the drawings, like reference numerals have been used throughout to identify identical elements.

According to devices and methods herein, a printing device uses helically formed rotating brushes to nudge printed sheets into a prepositioned registration corner. The rotation of the helical brush moves the sheet downward to the stacked position. The brush action gently moves the sheets toward two edge registration surfaces. As the stack grows higher, the brushes keep the stack registered against the edge guides. Brush rotation speed, bristle stiffness, and interference with the sheet can be adjusted to optimize performance. The description herein may refer to an "output tray". The devices and methods herein, however, may be applied to any tray or sheet restacking device, such as a duplex tray that restacks sheets prior to printing side two of a duplex document, which is not necessarily a final output tray FIG. 1 shows an example of a perspective view of a sheet registering apparatus, indicated generally as 111, according to devices and methods herein. The sheet registering apparatus 111 includes a tray 115 adapted to receive print media sheets, sometimes referred to as a sheet-receiving tray. The tray 115 has a base 119, a front end 123, a back end 127 opposite to the front end 123; a left side 131 relative to the front end 123, and a right side 135 opposite to the left side 131. The tray 115 receives print media sheets through the front end 123.

Registration guides are connected to the base 119. At least one first registration guide 139, 139*a* is connected to the tray 115 at the back end 127. At least one second registration guide 143 is connected to the tray 115 at one of the left side 131 and the right side 135. As shown in FIG. 1, the second registration guide 143 is connected to the right side 135. The first registration guide 139 and the second registration guide 143 define a corner 147 in the tray 115.

The sheet registering apparatus 111 includes a tamper mechanism, indicated generally as 150, comprising one or more tamper devices 151, 155, 159. Each of tamper devices 151, 155, 159 comprises a rotating helical brush extending perpendicularly from the base 119 adjacent to a side of the tray 115. Each of tamper devices 151, 155, 159 has a shaft 163, which is substantially vertical relative to the base 119, and bristles 167 attached to the vertical shaft 163. The bristles 167 attached to the vertical shaft 163 on the tamper devices 151, 155 located on the left side 131 of the tray 115 are in a right-hand pitch helical pattern. The bristles 167 attached to the vertical shaft 163 on the tamper device 159 located on the right side 135 of the tray 115 are in a left-hand pitch helical pattern. The tamper mechanism 150 is positioned to tamp print media sheets against the first registration guide 139 and the second registration guide 143 such that a stack of the print media sheets is squared against the corner 147. Note: the registration guides and tamper devices described herein may be mounted on adjustable mechanisms to optimize stacking of various sizes of sheets. Such adjustable mechanisms may be self-aligning.

Figure 2:
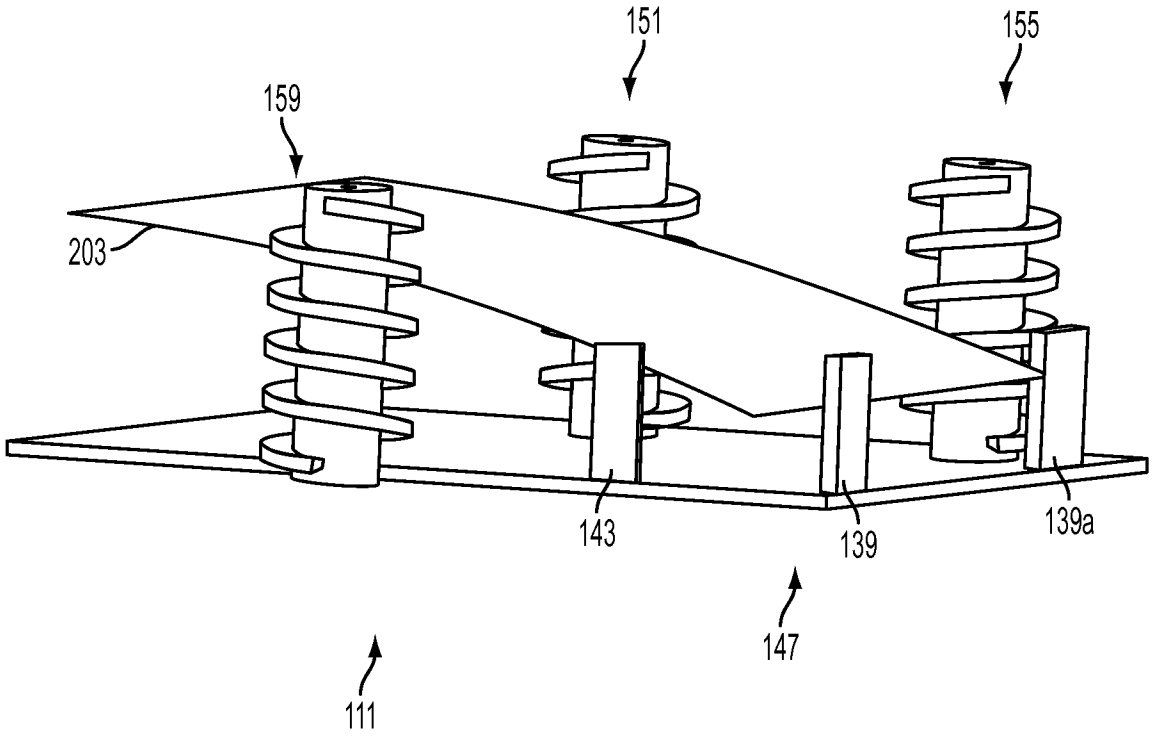
FIG. 2 is a side perspective view of a sheet registering apparatus according to devices and methods herein.
Figure 3:
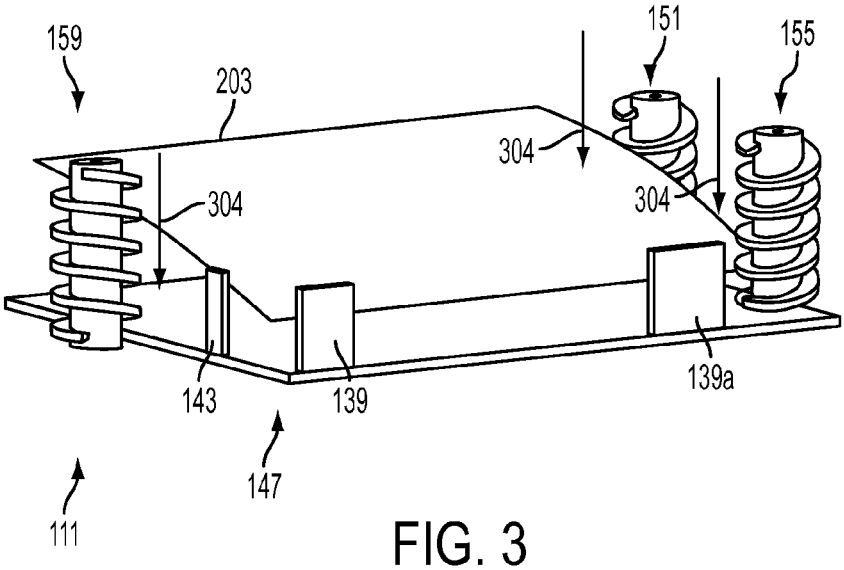
FIG. 3 is a front perspective view of a sheet registering apparatus according to devices and methods herein.
Figure 4:
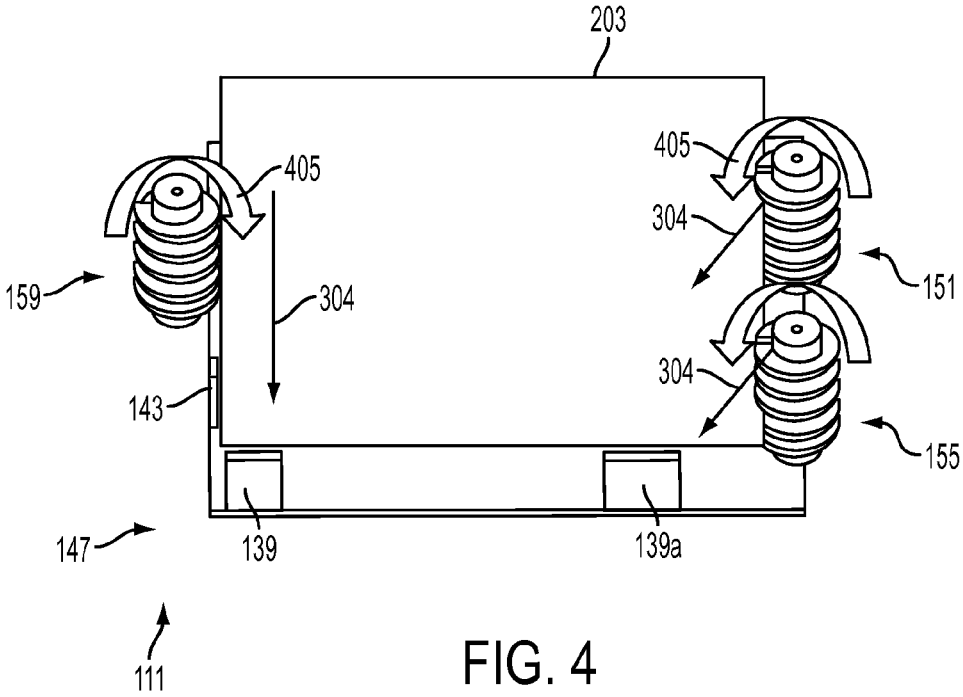
FIG. 4 is a top perspective view of a sheet registering apparatus according to devices and methods herein.
Figure 5:
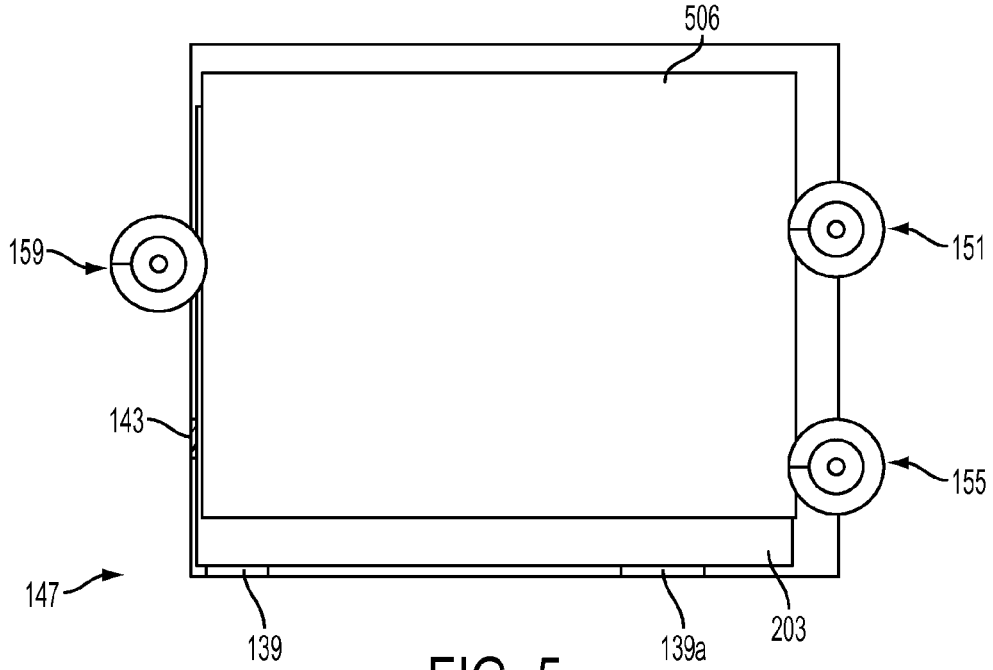
FIG. 5 is a plan view of a sheet registering apparatus according to devices and methods herein.

FIGS. 2-6 illustrate the operation of the sheet registering apparatus 111 according to devices and methods herein. Referring to FIG. 2, a print media sheet 203 is received as output from a printing device, as described in further detail below. In the example shown in FIGS. 2-6, tray 115 functions as an output tray. It is contemplated that the tray 115 may comprise any appropriate tray having a tamper mechanism 150. The print media sheet 203 is engaged by the tamper mechanism 150 with at least one of the tamper devices 151, 155, 159. In the case using only one tamper device, the device should be adjacent to the side of the tray 115 opposite the second registration guide 143. As illustrated in FIG. 2, this would be one of tamper devices 151, 155. In the case using two tamper devices, the devices should be on left side 131 and right side 135 side of the tray 115. As illustrated in FIG. 2, this would be tamper devices 151, 159. It is contemplated that any number of tamper devices can be used. (Note: as best shown in FIG. 5, tamper devices 151, 159 on opposite sides of the tray 115 need not be directly aligned across from each other.) The examples illustrated in FIGS. 2-6 use three tamper devices 151, 155, 159. The tamper devices 151, 155, 159 can be arranged in any location along the left side 131 and right side 135 of the tray 115 as long as the devices on the left side 131 have a right-hand pitch helical brush pattern and the devices on the right side 135 have a left-hand pitch helical brush pattern.

In FIGS. 3 and 4, the print media sheet 203 is moved into the tray 115 toward the registration guides 139, 143, by action of the bristles 167 attached to the tamper devices 151, 155, 159. That is, the print media sheet 203 is moved downward and forward, as indicated by arrows 304. The arrows 304 show the direction of forces from the rotating helical brushes. Note: according to devices and methods herein, the tamper devices 151, 155, 159 are rotating helical brushes that rotate in the directions indicated by arrows 405. That is, devices on the left side 131 of the tray 115 (tamper devices 151, 155) rotate in a counter-clockwise direction and devices on the right side 135 of the tray 115 (tamper device 159) rotate in a clockwise direction.

Figure 6:
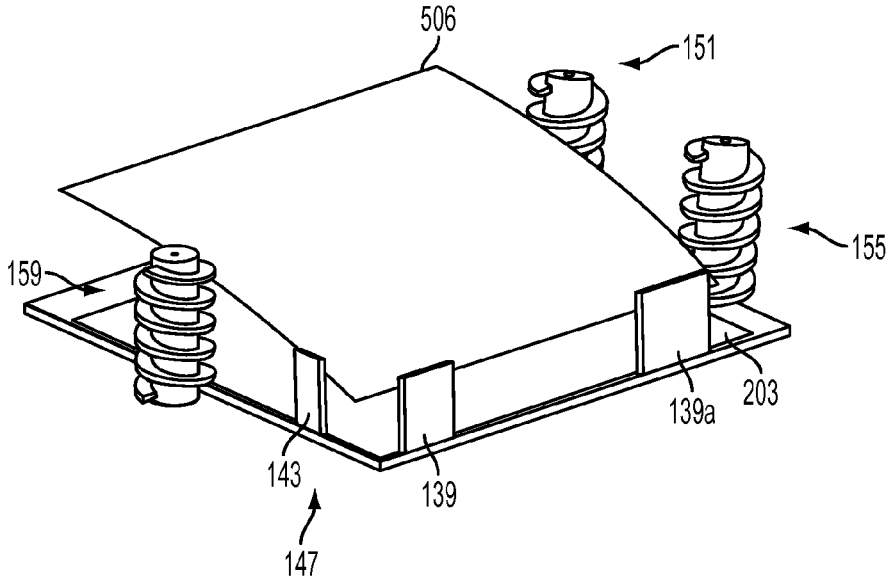
FIG. 6 is a perspective view of a sheet registering apparatus according to devices and methods herein.

FIG. 5 shows a plan view of the sheet registering apparatus 111 and FIG. 6 shows a perspective view of the sheet registering apparatus 111 according to devices and methods herein. In FIGS. 5 and 6, the print media sheet 203 has been moved into a stacked position in the corner 147 formed by the first registration guide 139 and the second registration guide 143. A second sheet 506 is received as output from the printing device and moved in a similar fashion onto the top of the print media sheet 203.

The print media sheets are continuously tamped against the registration guides 139, 143 in order to compile a stack of print media sheets such that, during the tamping, the stack is squared against the registration guides 139, 143.

Figure 7:
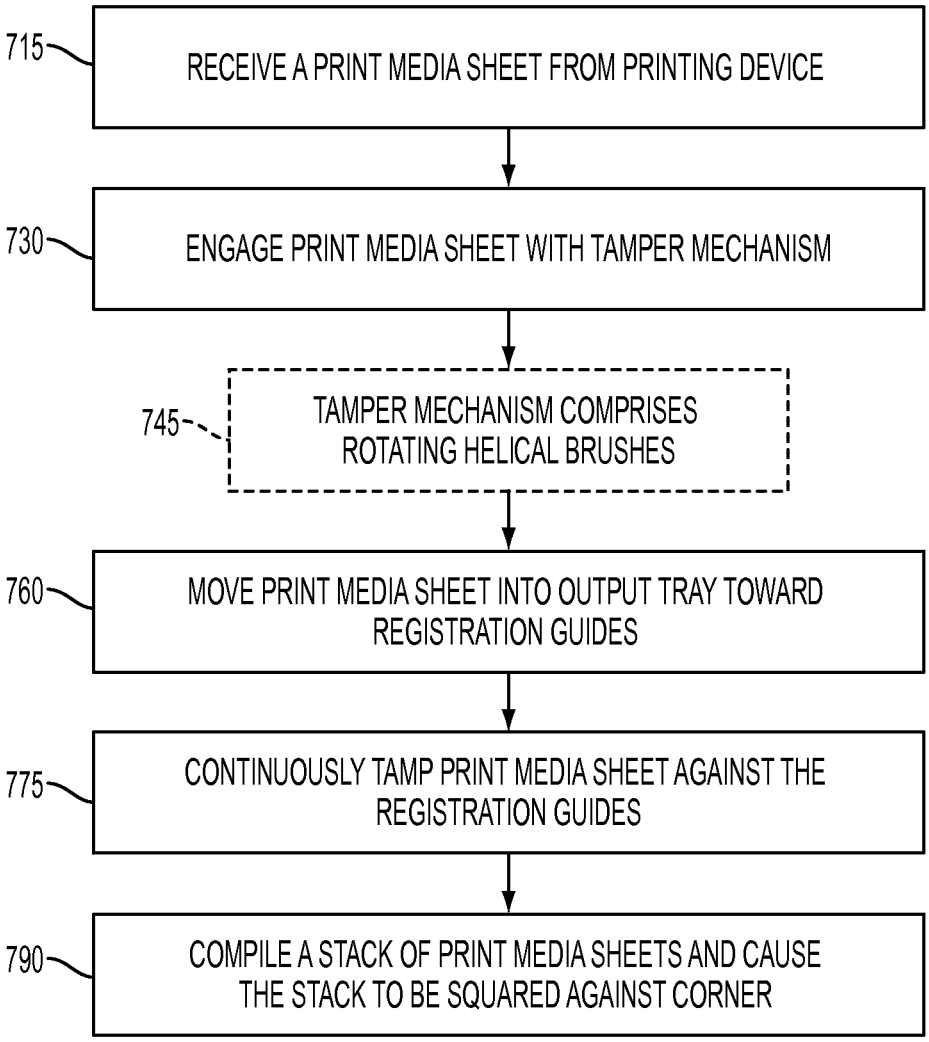
FIG. 7 is a flow diagram illustrating methods herein.

FIG. 7 is a flow diagram illustrating the processing flow of an exemplary method for collecting and aligning print media sheets of a printing device according to devices and methods herein. At 715, a print media sheet is received from the printing device into an output tray. At 730, the print media sheet is engaged with a tamper mechanism. As indicated at 745, the tamper mechanism comprises a rotating helical brush extending perpendicularly from a base of the output tray adjacent to a side of the output tray. The print media sheet is moved into the tray toward registration guides, at 760. The registration guides define a corner in the tray. At 775, the print media sheet is continuously tamped against the registration guides. At 790, a stack of print media sheets is compiled causing the stack to be squared against the corner.

Figure 8:
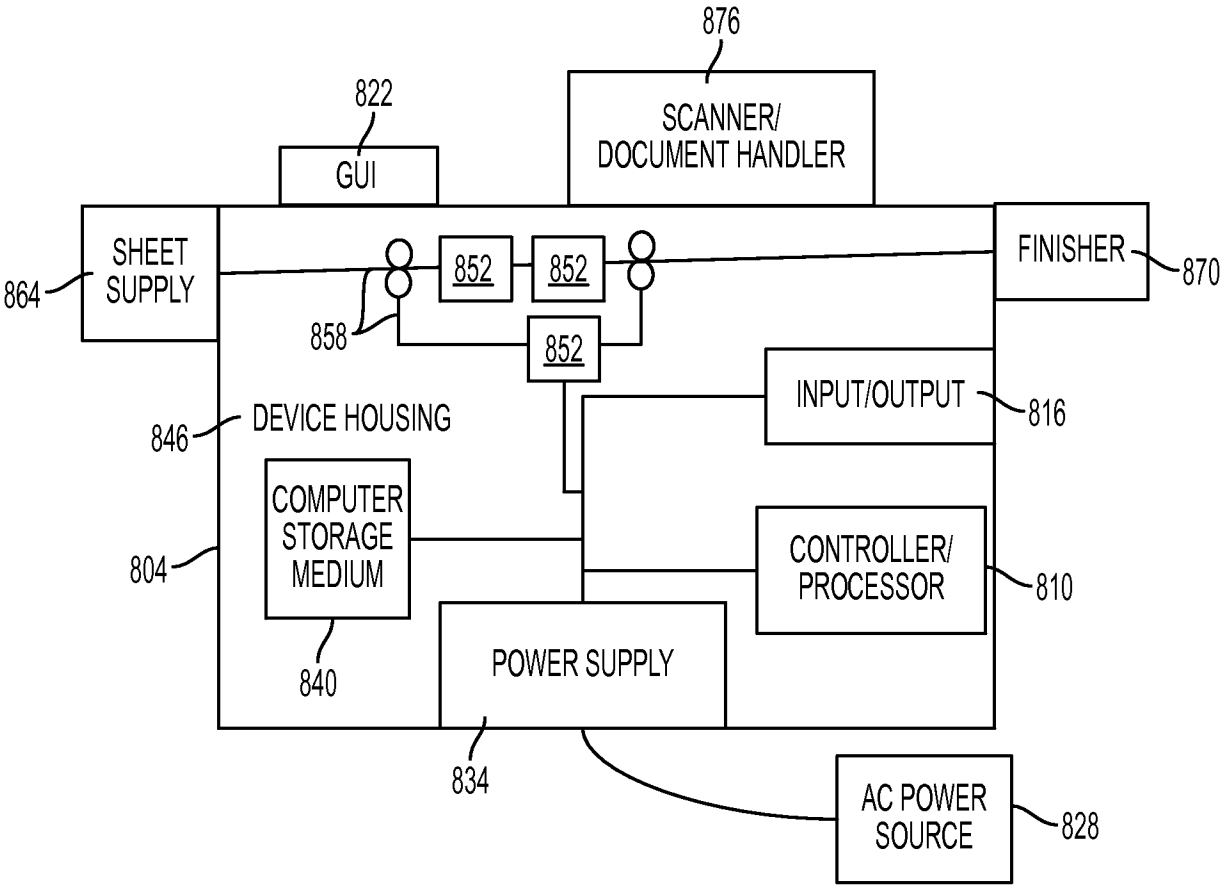
FIG. 8 is a side-view schematic diagram of a multi-function device according to devices and methods herein.
Figure 9:
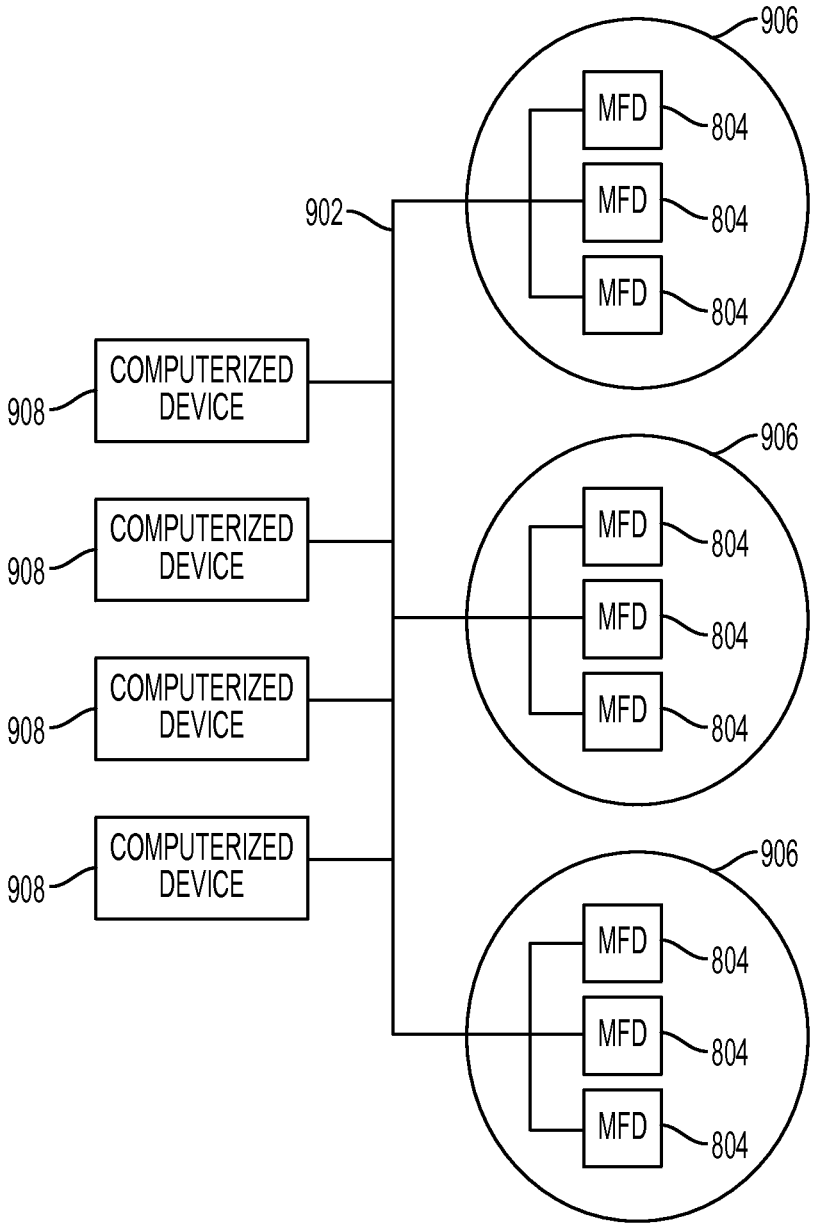
FIG. 9 is a schematic diagram illustrating devices and methods herein.

FIG. 8 illustrates a multi-function device 804 that can be used with devices and methods herein and can comprise, for example, a printer, copier, multi-function machine, etc. The multi-function device 804 includes a controller/processor 810 and a communications port (input/output) 816 operatively connected to the controller/processor 810 and to a network 902 external to the multi-function device 804, as shown in FIG. 9. In addition, the multi-function device 804 can include at least one accessory functional component, such as a graphic user interface (GUI) assembly 822 that operates on the power supplied from the AC power source 828, which may be external to the multi-function device 804. The AC power source 828 may provide electrical power through the power supply 834.

The controller/processor 810 controls the various actions of the multi-function device 804. A non-transitory computer storage medium device 840 (which can be optical, magnetic, capacitor based, etc.) is readable by the controller/processor 810 and stores instructions that the controller/processor 810 executes to allow the multi-function device 804 to perform its various functions, such as those described herein. Thus, as shown in FIG. 8, a device housing 846 has one or more functional components that operate on power supplied from the AC power source 828 by the power supply 834. The power supply 834 can comprise a power storage element (e.g., a battery) and connects to the AC power source 828, which may be external to the multi-function device 804. The power supply 834 converts the external power into the type of power needed by the various components.

The multi-function device 804 includes at least one marking device (printing engines) 852 operatively connected to the controller/processor 810, a media path 858 positioned to supply sheets of media from a sheet supply 864 to the marking device(s) 852, etc. After receiving various markings from the printing engine(s), the sheets of media can optionally pass to a finisher 870 which can fold, staple, sort, etc., the various printed sheets. In addition, the multi-function device 804 can include at least one accessory functional component (such as a scanner/document handler 876, etc.) that also operates on the power supplied from the AC power source 828 (through the power supply 834).

As would be understood by those ordinarily skilled in the art, the multi-function device 804 shown in FIG. 8 is only one example and the devices and methods herein are equally applicable to other types of printing devices that may include fewer components or more components. For example, while a limited number of printing engines and paper paths are illustrated in FIG. 8, those ordinarily skilled in the art would understand that many more paper paths and additional printing engines could be included within any printing device used with devices and methods herein.

As shown in FIG. 9, exemplary printers, copiers, multi-function machines, and multi-function devices (MFD) 804 may be located at various different physical locations 906. Other devices according to devices and methods herein may include various computerized devices 908. The computerized devices 908 can include print servers, printing devices, personal computers, etc., and are in communication (operatively connected to one another) by way of a network 902. The network 902 may be any type of network, including a local area network (LAN), a wide area network (WAN), or a global computer network, such as the Internet.

Aspects of the present disclosure are described herein with reference to flowchart illustrations and/or block diagrams of methods, apparatus (systems), and computer program products according to various devices and methods. It will be understood that each block of the flowchart illustrations and/or two-dimensional block diagrams, and combinations of blocks in the flowchart illustrations and/or block diagrams, can be implemented by computer program instructions. The computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

According to a further device and method herein, an article of manufacture is provided that includes a tangible computer readable medium having computer readable instructions embodied therein for performing the steps of the computer implemented methods, including, but not limited to, the method illustrated in FIG. 7. Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. Any of these devices may have computer readable instructions for carrying out the steps of the methods described above with reference to FIG. 7.

The computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Furthermore, the computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In case of implementing the devices and methods herein by software and/or firmware, a program constituting the software may be installed into a computer with dedicated hardware, from a storage medium or a network, and the computer is capable of performing various functions if with various programs installed therein.

In the case where the above-described series of processing is implemented with software, the program that constitutes the software may be installed from a network such as the Internet or a storage medium such as the removable medium. Examples of a removable medium include a magnetic disk (including a floppy disk), an optical disk (including a Compact Disk-Read Only Memory (CD-ROM) and a Digital Versatile Disk (DVD)), a magneto-optical disk (including a Mini-Disk (MD) (registered trademark)), and a semiconductor memory. Alternatively, the storage medium may be the ROM, a hard disk contained in the storage section of the disk units, or the like, which has the program stored therein and is distributed to the user together with the device that contains them.

As will be appreciated by one skilled in the art, aspects of the devices and methods herein may be embodied as a system, method, or computer program product. Accordingly, aspects of the present disclosure may take the form of an entirely hardware system, an entirely software system (including firmware, resident software, micro-code, etc.) or an system combining software and hardware aspects that may all generally be referred to herein as a "circuit," "module", or "system." Furthermore, aspects of the present disclosure may take the form of a computer program product embodied in one or more computer readable medium(s) having computer readable program code embodied thereon.

Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a Read Only Memory (ROM), an Erasable Programmable Read Only Memory (EPROM or Flash memory), an optical fiber, a magnetic storage device, a portable compact disc Read Only Memory (CD-ROM), an optical storage device, a "plug-and-play" memory device, like a USB flash drive, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++, or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The flowchart and block diagrams in the figures illustrate the architecture, functionality, and operation of possible implementations of systems, methods, and computer program products according to various devices and methods herein. In this regard, each block in the flowchart or block diagrams may represent a module, segment, or portion of code, which comprises one or more executable instructions for implementing the specified logical function(s). It should also be noted that, in some alternative implementations, the functions noted in the block might occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well known by those ordinarily skilled in the art and are discussed in, for example, U.S. Pat. No. 6,032,004, the complete disclosure of which is fully incorporated herein by reference. Such details are not described in detail herein to keep this disclosure focused on the salient features presented. The devices and methods herein can encompass devices that print in color, monochrome, or handle color or monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In addition, terms such as "right", "left", "vertical", "horizontal", "top", "bottom", "upper", "lower", "under", "below", "underlying", "over", "overlying", "parallel", "perpendicular", etc., used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms 'automated' or 'automatically' mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. A device, comprising:

a tray comprising a base, said tray receiving print media sheets;

registration guides connected to said tray, said registration guides defining a corner in said tray; and a tamper mechanism comprising rotating helical brushes extending perpendicularly from said base, said tamper mechanism comprising a first tamper device adjacent to a side of said tray opposite said corner, a second tamper device adjacent to a side of said tray adjacent to said corner, and a third tamper device adjacent to said first tamper device, said tamper mechanism being positioned to tamp said print media sheets against said registration guides causing a stack of said print media sheets to be squared against said corner.

2. The device according to claim 1, said registration guides comprising:

a first registration guide connected to an end of said tray; and a second registration guide connected to a side of said tray.

3. The device according to claim 1, each of said first tamper device, said second tamper device, and said third tamper device comprising a rotating helical brush comprising:

a shaft extending vertically relative to said base; and bristles attached to said shaft, said bristles forming a helical pattern that causes said print media sheets to move toward said base and into said corner.

4. The device according to claim 3, tamper devices on the left side of said tray having a right-hand pitch helical brush pattern; and tamper devices on the right side of said tray having a left-hand pitch helical brush pattern.

5. The device according to claim 4, tamper devices on said left side of said tray rotating in a counter-clockwise direction; and tamper devices on said right side of said tray rotating in a clockwise direction.

6. The device according to claim 1, said tamper mechanism engaging said print media sheets with said rotating helical brushes and causing said print media sheets to move into said tray toward said registration guides.

7. The device according to claim 1, said tamper mechanism continuously tamping said print media sheets against said registration guides.

8. A sheet registering apparatus, comprising:

a sheet-receiving tray;

registration guides connected to said sheet-receiving tray and defining a corner in said sheet-receiving tray;

a first rotating brush at a left side of said sheet-receiving tray, said first rotating brush having a vertical shaft relative to a base of said sheet-receiving tray and bristles attached to said vertical shaft in a right-hand pitch helical pattern;

a second rotating brush at a right side of said sheet-receiving tray, said second rotating brush having a vertical shaft relative to said sheet-receiving tray and bristles attached to said vertical shaft in a left-hand pitch helical pattern; and a third rotating brush at a side of said sheet-receiving tray opposite said corner, said third rotating brush having a vertical shaft relative to said base of said sheet-receiving tray and bristles attached to said vertical shaft in a helical pattern.

9. The sheet registering apparatus according to claim 8, said registration guides comprising:

a first registration guide connected to an end of said sheet-receiving tray; and a second registration guide connected to a side of said sheet-receiving tray.

10. The sheet registering apparatus according to claim 9, said first registration guide and said second registration guide defining said corner in said sheet-receiving tray.

11. The sheet registering apparatus according to claim 8, said first rotating brush, said second rotating brush, and said third rotating brush comprising a tamper mechanism, said tamper mechanism being positioned to tamp print media sheets against said registration guides causing a stack of print media sheets to be squared against said corner.

12. The sheet registering apparatus according to claim 8, said first rotating brush, said second rotating brush, and said third rotating brush comprising a tamper mechanism, said tamper mechanism engaging a print media sheet with said rotating brush and causing said print media sheet to move into said sheet-receiving tray toward said registration guides.

13. The sheet registering apparatus according to claim 12, said tamper mechanism continuously tamping said print media sheet against said registration guides.

14. A method of collecting and aligning print media sheets, said method comprising:

receiving a print media sheet into a sheet-receiving tray;

engaging said print media sheet with a tamper mechanism comprising a first tamper device adjacent to a first side of said tray, a second tamper device adjacent to a second side of said tray, said second side being opposite said first side, and a third tamper device adjacent to said first tamper device; and moving said print media sheet into said sheet-receiving tray toward registration guides, said registration guides defining a corner in said sheet-receiving tray.

15. The method according to claim 14, said registration guides comprising:

a first registration guide connected to an end of said sheet-receiving tray; and a second registration guide connected to a side of said sheet-receiving tray.

16. The method according to claim 14, each of said first tamper device, said second tamper device, and said third tamper device comprising a rotating helical brush comprising:

a vertical shaft relative to a base of said sheet-receiving tray; and bristles attached to said vertical shaft, said bristles forming a helical pattern that causes said print media sheet to move toward a base of said sheet-receiving tray and into said corner.

17. The method according to claim 14, said said first tamper device being adjacent to said side of said sheet-receiving tray opposite said corner;

said second tamper device being adjacent to a side of said sheet-receiving tray adjacent to said corner; and said third tamper device being adjacent to said side of said sheet-receiving tray opposite said corner.

18. The method according to claim 17, said tamper mechanism being positioned to tamp said print media sheet against said registration guides causing a stack of print media sheets to be squared against said corner.

19. The method according to claim 14, further comprising:

continuously tamping said print media sheet against said registration guides.

20. The method according to claim 14, further comprising:

compiling a stack of print media sheets and causing said stack of said print media sheets to be squared against said corner.

* * * * *